US009722295B2

(12) United States Patent
Ortel

(10) Patent No.: US 9,722,295 B2
(45) Date of Patent: Aug. 1, 2017

(54) BRACKET FOR MOUNTING RADIO EQUIPMENT TO A RADIO TOWER

(71) Applicant: TESSCO Communications Incorporated, Hunt Valley, MD (US)

(72) Inventor: Timothy Ortel, Timonium, MD (US)

(73) Assignee: TESSCO COMMUNICATIONS INCORPORATED, Hunt Valley, MD (US)

( * ) Notice: Subject to any disclaimer, the term of this patent is extended or adjusted under 35 U.S.C. 154(b) by 0 days.

(21) Appl. No.: 14/955,158

(22) Filed: Dec. 1, 2015

(65) Prior Publication Data

US 2016/0153609 A1 Jun. 2, 2016

Related U.S. Application Data

(60) Provisional application No. 62/086,441, filed on Dec. 2, 2014.

(51) Int. Cl.
*H01Q 1/12* (2006.01)
*A47B 81/06* (2006.01)

(52) U.S. Cl.
CPC ..... *H01Q 1/1228* (2013.01); *A47B 81/06* (2013.01); *H01Q 1/1242* (2013.01)

(58) Field of Classification Search
CPC .. H01Q 1/1228; H01Q 1/1242; H01Q 1/1207; A47B 81/06; A47B 96/1416
See application file for complete search history.

(56) References Cited

U.S. PATENT DOCUMENTS 2,118,396 A * 5/1938 Davis ..... H01Q 1/1242 174/129 B
5,272,991 A * 12/1993 Carrigan, Jr. ..... A47B 87/0207 108/108
5,971,345 A * 10/1999 Khalaf ..... H01Q 1/125 248/512
6,089,387 A * 7/2000 Varfolomeeva ..... A47B 57/06 211/106

(Continued)

*Primary Examiner* — Stanton L Krycinski
(74) *Attorney, Agent, or Firm* — Shlesinger, Arkwright & Garvey LLP

(57) ABSTRACT

A bracket for mounting radio equipment to a radio tower comprises a frame including first and second longitudinal pipe members opposed from each other, the first and second pipe members including a top portion, a center portion and a bottom portion, the first and second longitudinal pipe members being disposed vertically. The frame includes top, center and bottom rails attached to, respectively, to the top portion, the center portion and the bottom portion. The frame includes a front side and a rear side. Longitudinal plate members are attached to the first and second longitudinal pipe members between the top rail and the center rail and between the center rail and the bottom rail, the longitudinal plate members facing the front side and the rear side of the frame, the longitudinal plate members being disposed vertically along the first and second longitudinal pipe members. A radio plate is removably attached to and positionable along the longitudinal plate members between the top rail and the center rail; and a filter plate removably attached to and positionable along the longitudinal members between the center rail and the bottom rail.

14 Claims, 5 Drawing Sheets

(56) References Cited

U.S. PATENT DOCUMENTS

| | | | | |
|---|---|---|---|---|
| 7,113,145 | B1 * | 9/2006 | Noble | H01Q 1/1228 248/218.4 |
| 7,466,286 | B2 * | 12/2008 | Chapman | H01Q 1/1228 343/874 |
| 7,557,764 | B2 * | 7/2009 | Krajicek | H01Q 1/3275 343/713 |
| 7,659,865 | B2 * | 2/2010 | Kreitzberg | H01Q 1/1235 343/880 |
| 8,081,139 | B2 * | 12/2011 | Schmidt | H01Q 1/1207 248/285.1 |
| 9,010,715 | B2 * | 4/2015 | Lowe | F16M 11/28 248/514 |
| 2016/0302078 | A1 * | 10/2016 | Sivanandar | H01Q 1/1228 |

* cited by examiner

BRACKET FOR MOUNTING RADIO EQUIPMENT TO A RADIO TOWER

RELATED APPLICATION

This is a nonprovisional application of Provisional Application Ser. No. 62/086,441, filed on Dec. 2, 2014, hereby incorporated by reference.

FIELD OF THE INVENTION

The present invention is generally related to brackets for mounting equipment to a radio tower, and specifically to mounting brackets that provide a long term evolution (LTE) adjustable mounting bracket that accommodates any remote radio unit (RRU), antenna, and filter, wherein removable plates allow RRU's and filters to be changed out in the future without removing the entire bracket assembly from the tower.

SUMMARY OF THE INVENTION

The present invention provides a bracket for mounting radio equipment to a radio tower, comprising a frame including first and second longitudinal pipe members opposed from each other, the first and second pipe members including a top portion, a center portion and a bottom portion, the first and second longitudinal pipe members being disposed vertically. The frame includes top, center and bottom rails attached to, respectively, to the top portion, the center portion and the bottom portion. The frame includes a front side and a rear side. Longitudinal plate members are attached to the first and second longitudinal pipe members between the top rail and the center rail and between the center rail and the bottom rail, the longitudinal plate members facing the front side and the rear side of the frame, the longitudinal plate members being disposed vertically along the first and second longitudinal pipe members. A radio plate is removably attached to and positionable along the longitudinal plate members between the top rail and the center rail; and a filter plate removably attached to and positionable along the longitudinal members between the center rail and the bottom rail.

The present invention also provides a frame for mounting radio equipment to a radio tower, comprising first and second longitudinal pipe members opposed from each other, the first and second pipe members including a top portion, a center portion and a bottom portion, the first and second longitudinal pipe members being disposed vertically. The frame includes top, center and bottom rails attached to, respectively, to the top portion, the center portion and the bottom portion. The frame includes a front side and a rear side. Vertical rails for attachment of radio equipment. The vertical rails include longitudinal plate members are attached to the first and second longitudinal pipe members between the top rail and the center rail and between the center rail and the bottom rail, the longitudinal plate members facing the front side and the rear side of the frame, the longitudinal plate members being disposed vertically along the first and second longitudinal pipe members.

The adjustable mounting solution of the present invention allows the operator to install the RRU, antenna, and other equipment that make up an LTE unit in a controlled environment on the ground. Connections between the equipment can also be made at this time. The preassembled LTE unit can then be hoisted to the top of the tower for mounting.

DETAILED DESCRIPTION OF THE INVENTION

Figure 1:
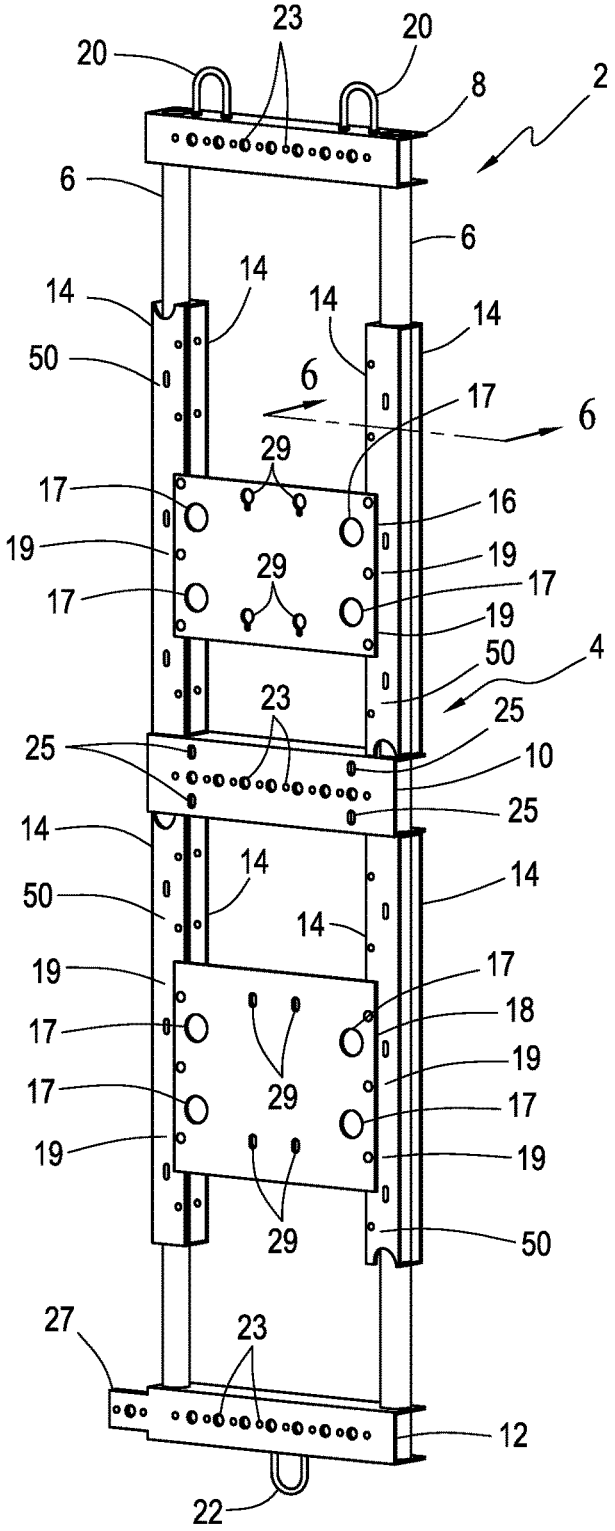
FIG. 1 is a perspective view of a bracket made in accordance with the present invention.

An adjustable bracket 2 is disclosed in FIG. 1. The bracket 2 is used for mounting remote radio units, filters and antennas to a standard radio tower, such as a single pole or a structure made of interconnected members. The bracket 2 comprises a welded frame 4 made up of two longitudinal pipe members 6 disposed spaced from each other and connected by a top rail 8, a center rail 10 and a bottom rail 12, which are welded to the pipe members 6. The pipe members 6 are preferably parallel to each. The pipe members 6 are preferably 2" diameter, schedule 40 pipes. The top rail 8, the center rail 10 and the bottom rail 12 are preferably parallel to each other and transverse to the pipe members 6. The pipe members 6 are preferably circular in cross-section (see FIG. 2).

Longitudinal plate members 14 are welded to the pipe members 6. A pair of the plate members 14 is welded to each section of the pipe members 6 between the top rail 8 and the center rail 10 and between the center rail 10 and bottom rail 12. The plate members 14 provide vertical attachment rails to the frame 4.

The entire frame 4 is galvanized to protect against corrosion. The frame 4 is a one-piece design that increases the speed of assembly of the equipment to be attached to the bracket 2 in the field and provides a rigid structure.

A radio plate 16 adjustably attached to two plate members 14 at an upper section of the frame 4. A filter plate 18 is adjustably attached to two plate members 14 at a lower section of the frame 4. The radio and filter plates are fastened to the welded frame 4 using ⅜" stainless steel bolts, washers and nuts. The radio plate 16 and the filter plate 18 have mounting holes 19 to align with the holes 50 (see FIG. 4) in the plate member 14. The mounting holes 19 allow the radio plate 16 or the filter plate 18 to be mounted along the length of the plate members 14 at the desired location depending on the equipment being attached to the plates. The plates 16 and 18 are secured to the plate members 14 using ⅜" stainless steel nuts, bolts and washers. Large wind relief holes 17 reduce the amount of wind loading on the plates 16 and 18. The plates 16 and 18 include mounting holes 29 configured for the type of equipment being installed.

Lifting U-bolts 20 are attached to the top rail 8. The U-bolts 20 are used for lifting the bracket 2 to the top of the tower where the bracket 2 will be attached in normal operation.

A control U-bolt 22 is attached to the bottom rail 12. The U-bolt 22 is advantageously used with a tag line held by a person on the ground to control the bracket 2 from swaying uncontrollably while being hoisted to the top of the tower.

The top rail 8, the center rail 10 and bottom rail 12 have alternating ½" and ¾" cable management holes 23. The holes 23 advantageously allow clips, cable ties, or other forms of cable management to be attached to the frame 4, providing a secure location to prevent cables from moving due to wind. Since the top rail 8, the center rail 10 and the bottom rail 12 are open at the rear, being C-shaped, access to the rear is advantageously provided for threading and securing cable ties through the openings 23.

The center rail 10 has strong arm mounting holes 25, which allow a pipe to be securely mounted to the frame 4 and the radio tower with U-bolts or other standard hardware to act as a stiffener if required. The bottom rail 10 has an extension 27 to provide cable management for the antenna cables.

Figure 2:
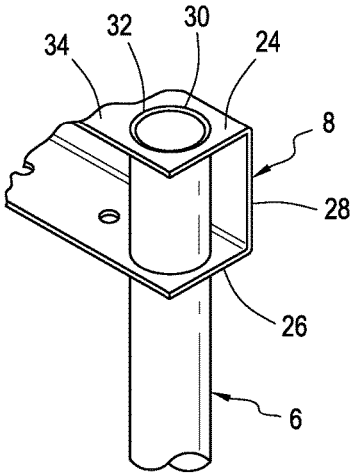
FIG. 2 is perspective partial view of a connection of a top rail to a pipe member.

Referring to FIG. 2, the top rail 8 is a C-shaped channel member with upper wall 24, bottom wall 26 and vertical wall 28. The walls 24 and 26 include openings 30 in which an end portion of the pipe member 6 is received. The pipe member 6 is welded to the bottom wall 26. The top edge 32 is offset from the tope surface 34 of the top wall 24. The space between the top edge 32 and top surface 34 is filled with welding to attach the pipe member 6 to the top rail 8. The detail shown in FIG. 2 also applies to the other pipe member 6 connections at the opposite end of the top rail 8. The bottom rail 12 connection to the pipe members 6 is the same as the connection of the top rail 8 to the pipe members 6. The bottom rail 12 has the same structure as the top rail 8, except for the extension 27.

Figure 3:
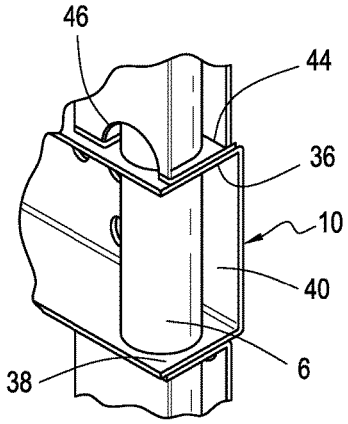
FIG. 3 is a perspective partial view of a connection of a center rail to a pipe member and a connection of the plate members to each other and to the center rail.

Referring to FIG. 3, one end of the center rail 10 is shown attached to the respective pipe member 6. The center rail 10 is C-shaped with upper wall 36, bottom wall 38 and vertical wall 40. The walls 36 and 38 include openings 42 in which an end portion of the pipe member 6 is received. The pipe member 6 is welded to the top wall 36 and the bottom wall 38. The detail shown in FIG. 3 also applies to the attachment of the other end of the center rail 10 to the other pipe member 6.

Figure 4:
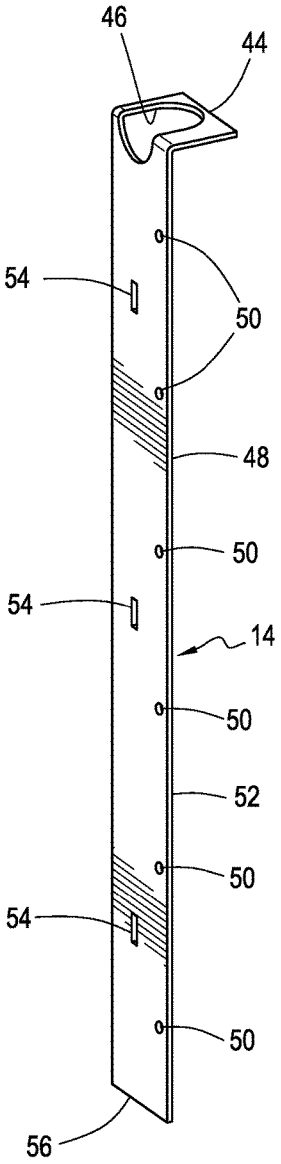
FIG. 4 is perspective view of a vertical plate member.

Referring to FIG. 4, each of the longitudinal plate members 14 includes a bent end portion 44 with a slot 46. The slot 46 is configured for the pipe member 6 to extend therethrough. The bent portion 44 is preferably perpendicular to the main portion 48. The slot 46 allows the correct size hole for the pipe member 6 to pass through and allows the plate member 14 to sit against the pipe member 6. The slot 46 allows the correct diameter hole in the bent portion 44 to allow the pipe member 6 to pass through and to rest against the plate member 14. If a round hole were made, the bending of the end portion would distort the hole and not allow the pipe member 6 to pass through.

Mounting holes 50 are provided vertically and along an edge portion 52 of the main portion 48. The holes 50 are arranged in equal intervals, preferably 6" on center, to advantageously provide adjustable vertical positioning of the radio plate 16 and the filter plate 18. When each plate member 14 is attached to the respective pipe member 6, the holes 50 are preferably disposed inwardly of the frame 4, rather than outwardly, as shown in FIG. 1, so that the radio plate 16 and the filter plate 18 are advantageously shorter to save weight.

Weld slots 54 are provided in the main portion 48, preferably centered along the length of the main portion 48. The slots 54 are used to weld the plate member 14 to the respective pipe member 6 along a tangent line where the plate member 14 engages the pipe member 6. A pair of the plate member 14 are attached to each section of the pipe member 6, as shown in FIG. 1.

Figure 5:
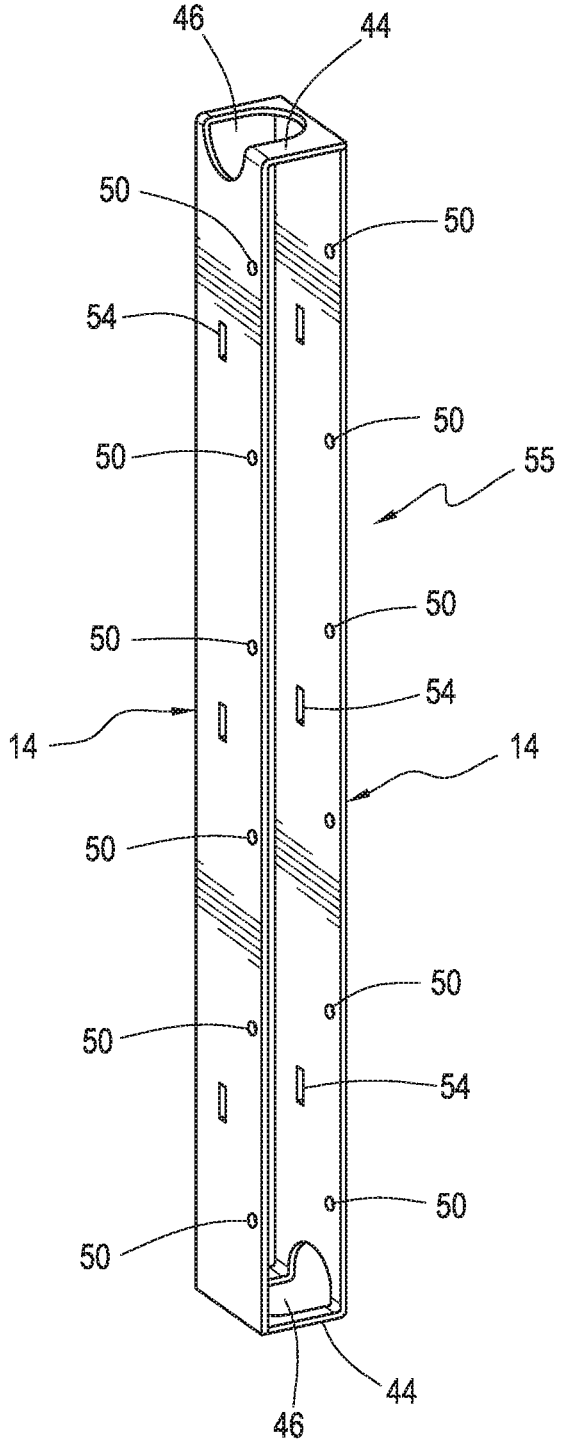
FIG. 5 is a perspective view of a pair of plate members joined in a box structure.

Referring to FIG. 5, the plate members 14 that make up a pair are joined together to form a box structure 55. The bent end portion 44 of one plate member 14 is joined to the straight end portion 56 of the other plate member 14 in the pair. Accordingly, the main portion 48 of one plate member 14 is opposite and parallel to main portion 48 of the other plate member 14; and the bent end portion 44 of one plate member 14 is opposite and parallel to the bent end portion of the other plate member 14. The slot 46 of one plate member 14 is opposite to the slot 46 of the other plate member 14. When attached to the pipe members 6, each box structure 55 will have the respective the mounting holes 50 disposed inwardly of the frame 4 (see FIG. 1) so that the plates 16 and 18 will not have to extend deeper into the width of the plate members 14, thus, saving weight on the plates 16 and 18. The box structure 55 advantageously provides a rigid structure to the individual plate members 14.

Although the box structure 55 is preferred, the plate members 14 without the bent portions 44 may also be used. In this case, the plate members 14 will only have the main portion 48, without the bent portion 44.

Figure 6:
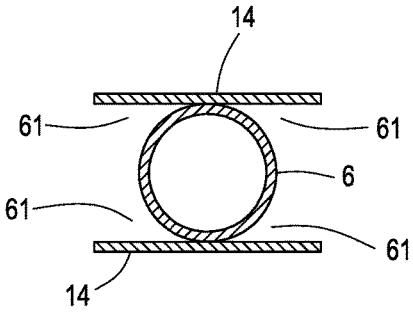
FIG. 6 is a cross-section along line 6-6 in FIG. 1.

Referring to FIG. 6, the section of the pipe member 6 is sandwiched between the two main portions 48 of the plate member 14 that make up the pair. By means of the plate member 14 attached on each side of the vertical pipe members 6, multiple radios and filters can be installed on the bracket 2. The plate members 14 overhang the respective pipe member 6 to advantageously provide working space 61 for attaching or removing the nuts and bolts that attach the plates 16 and 18 to the plate members 14. The plate members 14 form vertical rails on the front and rear of the frame 4 to which the radio equipment can be attached, using the mounting holes 29.

Figure 7:
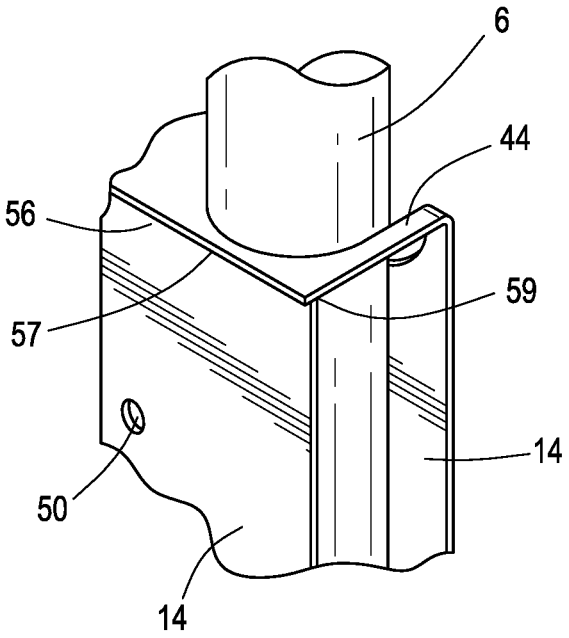
FIG. 7 is perspective partial view of a connection of the vertical plate members to a pipe member above the center rail.

Referring to FIG. 7, the edge portion 57 of the bent end portion 44 of one plate member 14 of a pair is welded to the edge portion 59 of the straight end portion 56 of the other plate member 14 of the pair. All the plate members 14 are joined together in the same way.

Figure 8:
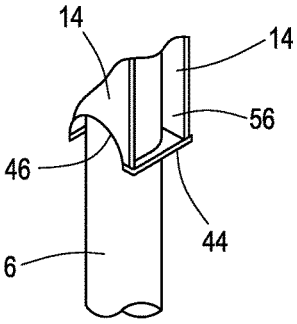
FIG. 8 is perspective partial view of a connection of the vertical plate members to a pipe member below the center rail.

Referring to FIG. 8, the edge of the slot 46 is welded to the pipe member 6. The other pairs of the plate members 14 are attached to the pipe members 6 in the same way.

Referring back to FIG. 3, the pair of plate members 14 is attached to the center rail 10 by welding the bent end portion to the top wall 36. For the pair of plate members 14 below the center rail 10, the bent end portion 44 is welded to the bottom wall 38. The other pairs of the plate members 14 are attached to the center rail 10 in the same way.

The vertical plate members 14 are mounted on either side of the center rail 10 to provide a symmetric pattern of the holes 50 to accept the radio plate 16 and the filter plate 18. The plate members 14 allow the plates 16 and 18 to be mounted in the desired distance apart to optimize cable management. Multiple RRU's can be mounted on a single bracket 2.

Figure 9:
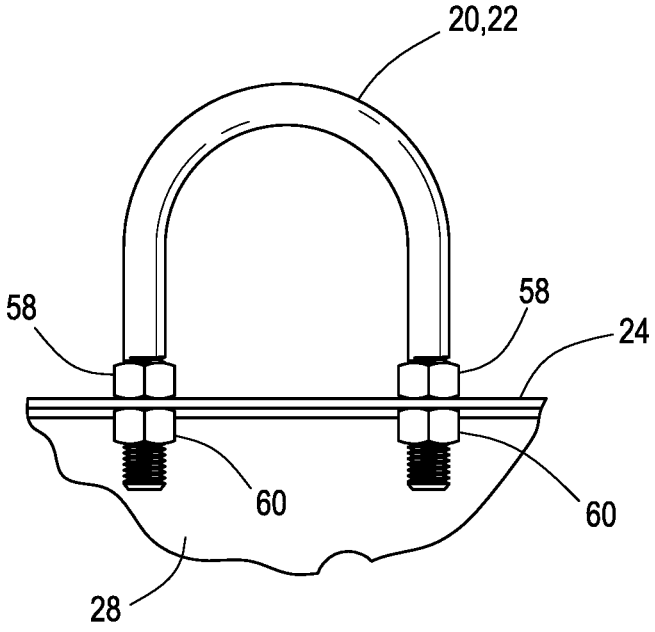
FIG. 9 is an elevational partial view of a connection of a U-bolt to a central or bottom rail.

Referring to FIG. 9, the U-bolt 20 is attached to the top wall 24 of the top rail 8 with nuts 58 and 60. The nuts 58 and 60 are welded to the top wall 24 after tightening. The U-bolt 22 is attached to the bottom rail 12 in the same manner.

Figure 10:
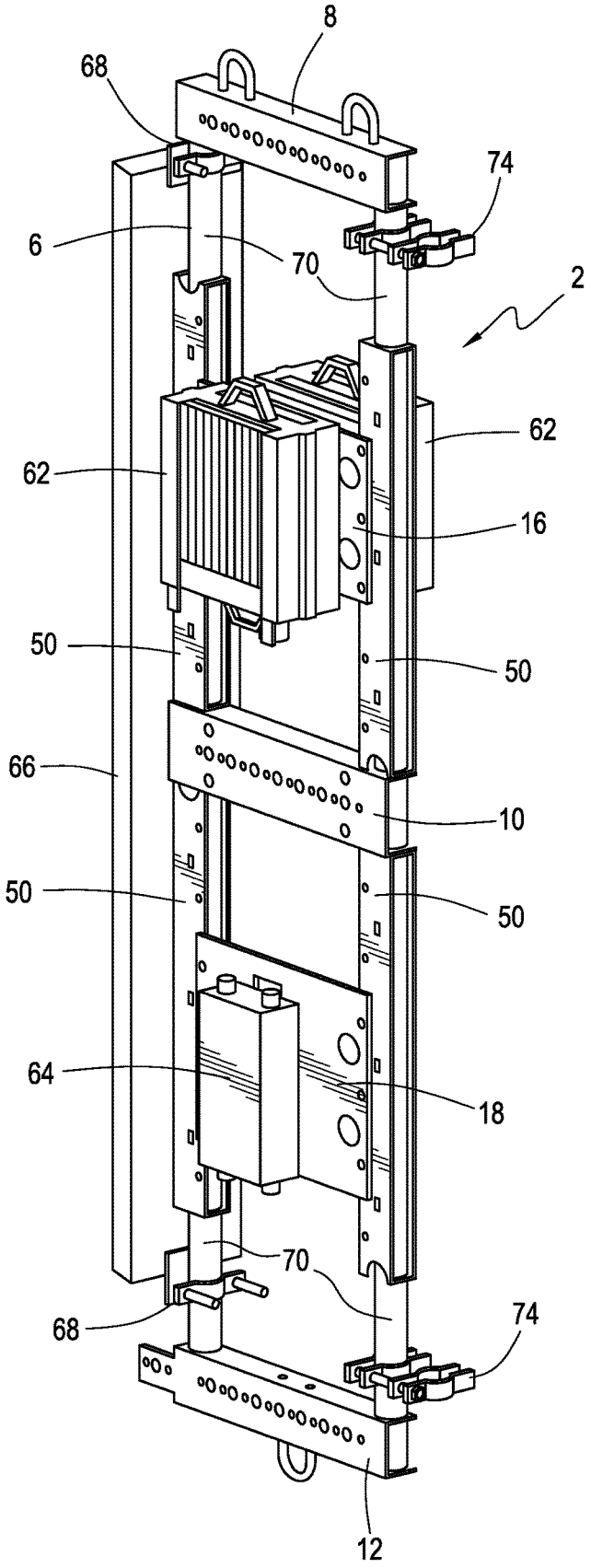
FIG. 10 is a perspective view of the bracket of FIG. 1 with equipment attached.

Referring to FIG. 10, the bracket 2 is shown equipped with two remote radio units 62, a filter 64 and an antenna 66. The radio units 62 are attached to the respective radio plates 16 on the front and the rear of the frame 4. The filter 64 is attached to the filter plate 18. The antenna 66 is attached to the pipe member 6 with clamps 68. Since the plate members 14 are shorter than the pipe member sections between the top rail 8 and the center rail 10, and between the center rail 10 and the bottom rail 12, portions 70 of the pipe members 6 are uncovered by the plate member 14. The portions 70 are advantageously used for attaching the antenna 66 to the bracket 2 with the clamps 68. Further, the portions 70 are used to attach the bracket to the tower with pole-to-pole clamps 74. Preferably, the uncovered portions 70 are disposed adjacent the top rail 8 and the bottom rail 12 for secure attachment to the radio tower or to the antenna 66 with maximum leverage.

The bracket 2 is advantageously made to hold one or two radios and provides attachment provision for the antenna 66 and the filter 64 for a complete LTE system.

The bracket 2 is not limited to a specific manufacturer of antenna, radio and cables to create a system. Users can advantageously choose the type of radio and antenna that they want to use. The bracket 2 can advantageously accommodate many antennas and radios allowing the user to have one bracket to fit all needs.

The bracket 2 provides a sturdy one-piece frame that can accommodate any remote radio unit, antenna, and filter to create a remote radio system. The bracket 2 is a one-piece frame 4 and does not have to be assembled in the field. The bracket 2 provides accommodations for cable management.

The bracket 2 allows the user to install the radio, antenna and filter of its choice on the ground before hoisting it to the top of the radio tower. This advantageously saves a lot of time and money and makes the assemblers time exposed to the elements at the top of the tower far less.

The radio plate 16 and the filter plate 18 are removable to allow equipment to be swapped out as technology changes without taking the entire bracket 2 off the radio tower. The holes 29 can be drilled or punched to accommodate any equipment-mounting pattern. The plates 16 and 18 can be advantageously replaced or modified when new equipment is required without having to remove the entire bracket assembly from the tower. Accordingly, as radio technology improves, the plates 16 and 18 can be easily modified to accept new equipment.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A frame for mounting radio equipment to a radio tower, comprising:
   a) first and second longitudinal pipe members opposed from each other, said first and second pipe members including a top portion, a center portion and a bottom portion, said first and second longitudinal pipe members being disposed vertically;
   b) said frame including top, center and bottom rails attached to, respectively, to said top portion, said center portion and said bottom portion;
   c) said frame including a front side and a rear side; and
   d) vertical rails comprising longitudinal plate members attached to said first and second longitudinal pipe members between said top rail and said center rail and between said center rail and said bottom rail, said longitudinal plate members facing said front side and said rear side of said frame, said longitudinal plate members being disposed vertically along said first and second longitudinal pipe members.

2. A frame as in claim 1, wherein said first and second longitudinal pipe members are circular in cross-section.

3. A frame as in claim 1, wherein said top, center and bottom rails are U-shaped in cross-section.

4. A frame as in claim 1, wherein said top, center and bottom rails include openings for tying cables thereto.

5. A frame as in claim 3, wherein:
   a) said top, center and bottom rails include openings, one at each end of said top, center and bottom rails; and
   b) said openings are configured to receive said first and second longitudinal pipe members.

6. A frame as in claim 3, wherein a U-bolt is attached to said top rail and said bottom rail.

7. A frame as in claim 1, wherein:
   a) each of said longitudinal plate members includes an L-shaped end portion and an opposite end portion; and
   b) said L-shaped end portion includes a slot configured to receive a respective one of said first and second longitudinal pipe members.

8. A frame as in claim 7, wherein:
   a) a pair of said longitudinal plate members is attached to a respective portion of said first and second longitudinal pipe members;
   b) one of said pair of said longitudinal plate members is attached facing said front side of said frame; and
   c) another one of said pair of said longitudinal members is attached facing toward said rear side of said frame.

9. A frame as in claim 8, wherein:
   a) said L-shaped end portion of each of said longitudinal plate members of said pair of said longitudinal plate members are disposed diagonally opposite each other; and
   b) said L-shaped end portion of one of said pair of said longitudinal plate members is attached to said opposite end portion of said another one of said pair of said longitudinal plate members.

10. A frame as in claim 1, wherein said longitudinal plate members include slots for welding said longitudinal plate members to said first and second longitudinal pipe members.

11. A frame as in claim 1, wherein said longitudinal plate members are attached nearer said center rail than said top rail or said bottom rail such that a portion of said first and second longitudinal pipes is exposed.

12. A frame as in claim 1, wherein said longitudinal plate members include equally spaced openings arranged vertically.

13. A frame as in claim 1, wherein said bottom rail includes an extension with openings.

14. A frame as in claim 12, and further comprising:
   a) a first plate removably attached to and positionable along said longitudinal plate members between said top rail and said center rail, said first plate including attachment openings alignable with said openings in said longitudinal plate members; and b) a second plate removably attached to and positionable along said longitudinal members between said center rail and said bottom rail, said second plate including attachment openings alignable with said openings in said longitudinal plate members.

* * * * *